US005273171A

United States Patent [19]

Steele-Rowland et al.

[11] Patent Number: 5,273,171

[45] Date of Patent: Dec. 28, 1993

[54] DISPOSABLE NURSING CONTAINER

[75] Inventors: Maricoma Steele-Rowland, 614 Orindo Dr., Durham, N.C. 27713; Robert Williams, Raleigh, N.C.

[73] Assignee: Maricoma Steele-Rowland, Durham, N.C.

[21] Appl. No.: 23,348

[22] Filed: Feb. 26, 1993

Related U.S. Application Data

[63] Continuation-in-part of Ser. No. 968,298, Oct. 29, 1992.

[51] Int. Cl.[5] ..... A61J 9/00

[52] U.S. Cl. ..... 215/11.1; 220/277; 220/278; 215/250

[58] Field of Search ..... 215/11.1, 228, 250, 215/257; 220/212, 277, 278, 710, 711; 229/125.15, 162

[56] References Cited

U.S. PATENT DOCUMENTS

| | | | |
|---|---|---|---|
| 2,519,986 | 8/1950 | Trout | 215/11.1 |
| 2,628,909 | 2/1953 | Horan et al. | 215/11.1 |
| 2,628,912 | 2/1953 | Horan | 215/11.3 |
| 3,097,757 | 7/1963 | Searer | 215/11.1 |
| 3,255,923 | 6/1966 | Soto | 222/80 |
| 3,495,993 | 2/1970 | Barr et al. | 215/11.1 X |
| 3,804,952 | 4/1974 | MacDonald | 215/11.1 |
| 3,872,992 | 3/1975 | Larson | 215/11.1 X |
| 4,193,506 | 3/1980 | Trindle et al. | 215/11.6 |
| 4,412,623 | 11/1983 | Schmidt | 215/11.1 |
| 4,678,092 | 7/1987 | Rane | 215/11.1 |
| 4,706,827 | 11/1987 | Cabernoch et al. | 215/11.1 |
| 4,801,007 | 1/1989 | Rule | 215/11.3 |
| 4,830,205 | 3/1989 | Hammond et al. | 215/11.1 |
| 4,867,324 | 9/1989 | Rogosich et al. | 215/11.1 |
| 4,907,722 | 3/1990 | Ueda et al. | 220/278 X |
| 4,930,683 | 6/1990 | Färber | 220/278 X |
| 5,048,691 | 9/1991 | Heuberger et al. | 229/162 X |
| 5,169,026 | 12/1992 | Patterson | 220/711 X |

FOREIGN PATENT DOCUMENTS

| | | | |
|---|---|---|---|
| 57559 | 9/1982 | European Pat. Off. | 215/11.5 |
| 2653749 | 5/1991 | France | 215/11.3 |
| 358010 | 10/1931 | United Kingdom | 215/11.5 |
| 2181062 | 4/1987 | United Kingdom | 215/11.3 |

*Primary Examiner*—Allan N. Shoap
*Assistant Examiner*—Christopher McDonald
*Attorney, Agent, or Firm*—Olive & Olive

[57] ABSTRACT

A disposable nursing rectangular container having an interior space for holding a nursing liquid. A removably covered nipple attachment piece having an attached nipple, is located on the top of the container. A puncture piece on the nipple piece is used to pierce an access port on the top of the container so that liquid can flow into the nipple. Preferably the container has a liquid level gauge area on an end to allow viewing of the amount liquid in the container.

5 Claims, 1 Drawing Sheet

DISPOSABLE NURSING CONTAINER

CROSS-REFERENCE TO RELATED APPLICATIONS

This patent application is a continuation-in-part of copending U.S. patent application Ser. No. 07/968,298 filed Oct. 29, 1992. The disclosure of this co-pending patent application is incorporated herein by reference.

BACKGROUND OF THE INVENTION

1. Field of the Invention

This invention relates to disposable nursing containers for liquids, and in particular to nursing containers with nipples.

2. Description of the Related Art

Numerous patents have issued for various types of baby bottles or other containers for dispensing liquids to babies. These containers differ from each other in such characteristics as the means of attaching a nipple to the container, type of nipple, the use of various interior liners or inner containers for holding the liquid, and overall design of the container itself.

Because of the need of the babies' caregivers to have a portable supply of milk or other liquids, and the need to keep opened but unused containers of milk refrigerated between uses, a number of individual, prepackaged containers of milk or other liquid nutrients have been developed. Many of these containers include nipples and nipple attachment means. For example, the disposable baby bottle of Howland (U.S. Pat. No. 3,746,198) is essentially the same as previous bottles in shape but is vacuum sealed and has a threaded cap to removably receive a nipple. The nipple may be provided in sterilized form in a sealed cap to the baby bottle.

The baby-feeding packs of Hammond (U.S. Pat. No. 4,830,205) are flexible pouch-like bags having a liquid-containing compartment, and an auxiliary compartment with a folded gusset for containing the nipple. When the gusset is inverted after opening of the auxiliary compartment, the nipple is presented for access.

Similarly, the disposable liquid storage device of Soto (U.S. Pat. No. 3,255,923) has two pouches, one of which preferably contains the liquid to be dispensed, and the other of which preferably contains a dispensing means such as a nipple. A connector in the liquid pouch is used to break through the wall between the two pouches, so that the nipple may be attached to the connector.

The nursing container of Cabernoch et al. (U.S. Pat. No. 4,706,827) has a rigid outer container, for example, of rigid plastic and an inner flexible container. A self-opening nipple assembly is sealed to the flexible pouch and attached to the inside of the rigid container. A nipple access member inside the nipple is used to puncture the flexible container. Multiple nursing containers may be packaged together, for example, as a six-pack.

Other liquid containers may be used with standard nipples. The disposable baby bottle of Rane (U.S. Pat. No. 4,678,092) is a substantially cylindrical pouch terminating at an open end and containing a premeasured amount of liquid. An annular ring covered by a sealing cover with a pull tab is molded to the open end. A conventional ring and nipple assembly can be threaded on to the annular ring after removal of the sealing cover. The disposable nursing device of Eckholm (U.S. Pat. No. 3,777,925) has an inwardly tapering upper outer housing of rigid material, and an inner collapsible thin-walled bag. The top of the housing is adapted to receive a nipple.

Rogosich developed a nursing attachment for disposable beverage containers (U.S. Pat. No. 4,867,324 so that commercial beverage containers may be converted into a disposable nursing container. A hollow nipple in fluid communication with the hollow area of a puncturing means is secured to the hollow stem with an annular retaining ring.

Most of the prior nursing containers are not easily transportable or are not disposable, small volume packages for one-time use by a caregiver. Many prior containers also do not provide the caregiver with the option of carrying and using a single container, or of transporting a plurality of containers as a single unit. Thus, the prior disposable nursing containers are cumbersome to carry in quantity. For portable use, prepackaged liquids for babies and infants, which do not include nipples require that a nipple be separately cleaned, sterilized, and carried by the user. In addition, with many of the prior nursing containers, particularly the disposable ones or others made of non-transparent materials, it is difficult to determine how much of the liquid has been consumed.

Prior nursing containers in which the nipple needs to be handled and attached to the container opening have the disadvantage of possible contamination of the nipple, and of leakage due to careless attachment or an attachment means which does not fit together tightly.

It is therefore an object of this invention to provide a disposable nursing container for sterilized liquids which does not require handling of the nipple for attachment to the container or for release of liquid into the nipple.

It is a further object of this invention to provide a disposable nursing container for sterilized liquids which may either be carried and used singly, or may be carried in multiple unit carrying packs.

It is a further object of this invention to provide an easily usable disposable nursing container with which a nipple dispensing means is included.

It is a further object of this invention to provide a disposable nursing container for liquids which allows easy visual determination of how much of the liquid has been consumed.

Other objects and advantages will be more fully apparent from the following disclosure and appended claims.

SUMMARY OF THE INVENTION

The disposable nursing container of the invention comprises a container having an interior space for holding a nursing liquid. The container has six rectangular walls which together form the shape of a rectangular solid for holding the liquid. On one of the walls in the preferred embodiment is a rectangular covered nipple attachment area to which a nipple is attached. On the rectangular cover over an access port on the top of the container is a puncture piece which may be depressed to puncture the top and release liquid into the nipple. In a preferred embodiment the container has a liquid level gauge area on a second wall so that the volume of liquid in the container may easily be determined. Other aspects and features of the invention will be more fully apparent from the following disclosure and appended claims.

DETAILED DESCRIPTION OF THE INVENTION AND PREFERRED EMBODIMENTS THEREOF

The disposable nursing container of the present invention comprises a generally rectangular container having an interior space for holding a nursing liquid and a means of providing a nipple to the user for access to the nursing liquid.

Figure 1:
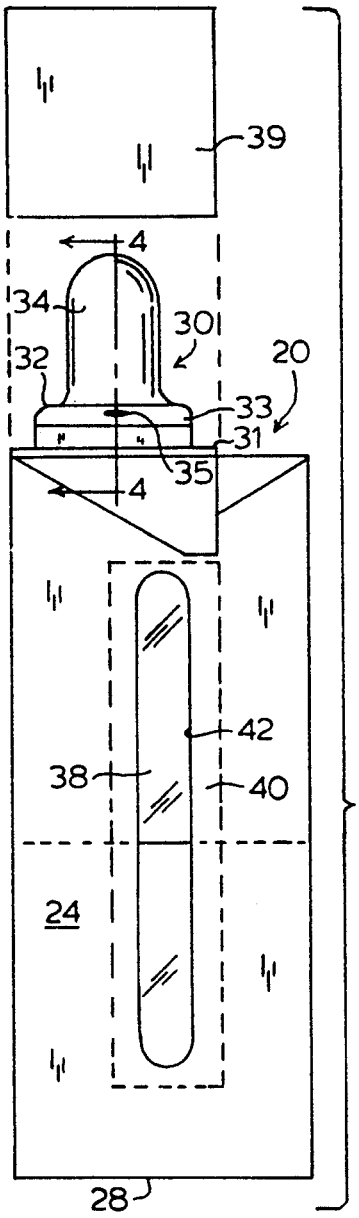
FIG. 1 is an elevational side view of a disposable nursing container having a rectangular nipple attachment piece and a cap according to the invention.
Figure 2:
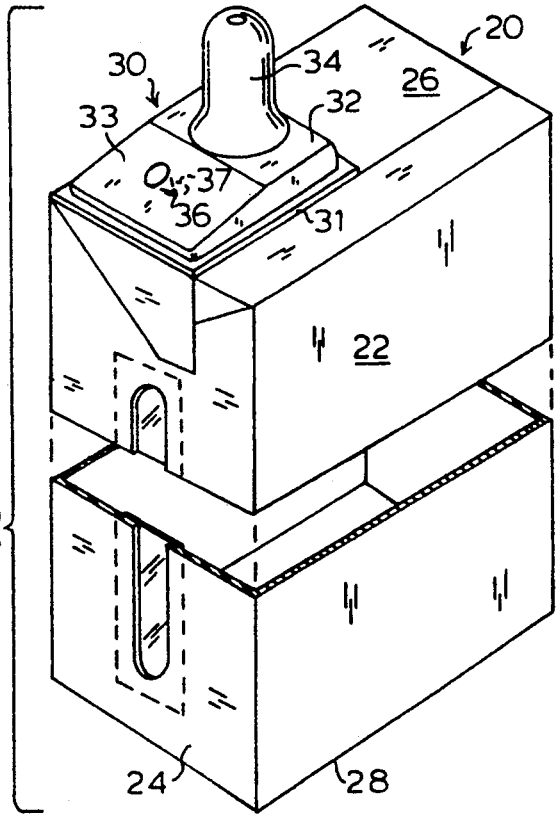
FIG. 2 is a partial perspective view of the container of FIG. 1.

Referring now to the Figures, the container 20 of the invention has six rectangular walls, which include two side walls 22, two end walls 24, one top wall 26 and a one bottom wall 28 (FIGS. 1-2). Preferably the side walls 22 are the largest of the walls in cross-sectional area, but the relative dimensions of the walls are not critical, except to the extent they adversely affect the ease of holding of the container.

Figure 3:
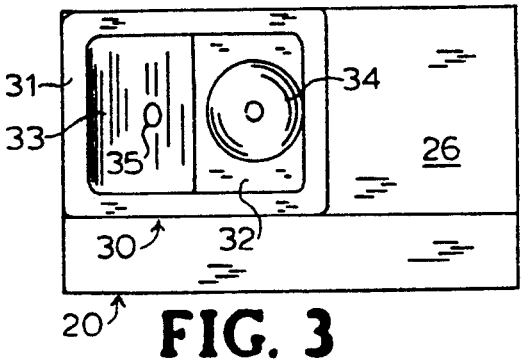
FIG. 3 is a top plan view of the rectangular cover and nipple on the nursing container of the invention.
Figure 4:
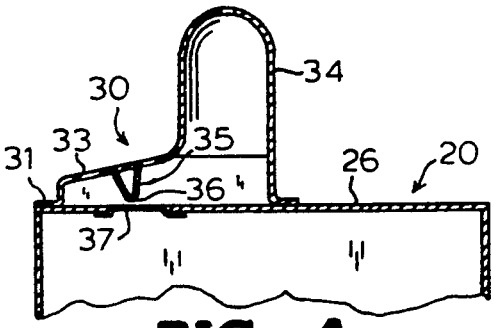
FIG. 4 is a partial cross-sectional view of the container and the rectangular cover and nipple of the nursing container of the invention.

A rectangular nipple attachment piece 30 (FIG. 3) is provided on a first wall, which is shown as and preferably is the top wall 26. The nipple attachment piece 30 preferably has a peripheral lower flange 31 which is attached to the top wall 26 by means known in the art, for example by glue or other adhesive. Preferably, the nipple attachment piece 30 has a flat portion 32 on which a nipple 34 is preferably integrally formed, and a gently sloped portion 33 into which is preferably molded a puncture piece 35. Preferably the nipple attachment piece 30 and nipple 34 are made of flexible plastic material such as is commonly used for nipples. Using methods known in the art, the puncture piece 35 is preferably molded with the nipple attachment piece 30 but using a harder plastic, or has hardened material incorporated therein, and is bonded during hardening of the material(s) to the nipple attachment piece 30, or is otherwise firmly attached to the sloped portion 33 of the nipple attachment piece 30. The puncture piece 35 is preferably conical and has a point 36, which is positioned directly over a standard access port 37 located on the top wall 26 of the container 20 beneath the nipple attachment piece 30 (FIG. 4). The access port 37 seals the liquid into the container 20 at a hole in the container until it is punctured, and is made of a puncturable material such as foil. When the sloped portion 33 of the nipple attachment piece 30 is depressed, the puncture piece 35 punctures the puncturable access port 37 and fluid can be released into the area defined by the nipple attachment piece 30 and nipple 34, and by the top of the box over which the nipple attachment piece 30 and nipple 34 are located.

Preferably, a cover 39 is removably attached to the container 20. The cover 39 is shown in FIG. 1. The cover 39 may be any plastic or other material and either may fit just over the nipple attachment piece and nipple 30 as shown, or may fit over the entire top of the container 20 as is known in the art. The means of attachment of the cover 39 to the container 20 is, for example, by friction, before the container is used, and while it is not being used.

Preferably the container has a liquid level gauge 38 on one of the walls (FIGS. 1 and 2). Preferably the liquid level gauge 38 is on an end wall 24 which has a lower expanse of wall surface between the edges of the container than do the side walls 22 so that presence of the gauge 38 does not appreciably weaken the wall. Preferably the gauge 38 is positioned on the end wall 24 so that it is oriented vertically when the bottom wall 28 rests on a horizontal surface.

The gauge 38 preferably comprises an elongated slit 42 in the appropriate wall which is covered by a transparent or translucent window piece 40 so that the liquid does not leak out of the slit 42 and contamination does not enter the slit 42. The level of the liquid can be seen easily through window piece 40 in the slit 42 (FIG. 1). The window piece 40 may, for example, be made of sturdy or flexible plastic which is glued to the interior of the container. Alternatively, the window piece may be external to the container, but this embodiment is less preferable because of the greater likelihood of accidentally dislodging the window piece.

The container of the invention is preferably manufactured in generally the same manner as paper or cardboard juice boxes, and of similar materials, as are acceptable for use by the food industry. The box manufacture of the container 20 of the invention also includes the additional step(s) in the various preferred embodiments of addition of the liquid level gauge 38 and nipple attachment piece and cover 36. The sterilized liquid is added preferably to containers which have been sterilized prior to or after assembly by means known in the art, for example, by steam, radiation, or dry heat.

Preferably the various embodiments of the container of the invention are sold in multi-packs as shown in copending application Ser. No. 07/968,298 having a plurality of containers. Thus, two or more containers are preferably held together by a complete or partial covering of plastic as is known in the art for small juice boxes so that individual containers may be easily removed for use. Alternatively, multiple containers may be held together in cardboard or other packaging (not shown) as is known in the art, by adhesive, and the like.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A disposable nursing container, comprising:

(a) a container having an interior space for holding a sterilized nursing liquid, said container having six walls together forming a rectangular box; and (b) a rectangular nipple attachment piece on a first wall of said walls, a portion of which attachment piece is located over a puncturable access port on said first wall; wherein said nipple attachment piece comprises a nipple positioned adjacent to and laterally spaced from said portion.

2. A disposable nursing container according to claim 1, further comprising a liquid level gauge area on a second wall.

3. A disposable nursing container according to claim 1, further comprising a puncture piece attached to said portion of said rectangular nipple attachment piece and positioned over said access port.

4. A disposable nursing container, comprising:

(a) a container having an interior space for holding a sterilized nursing liquid, said container having six walls together forming a rectangular box; and (b) a rectangular nipple attachment piece on a first wall of said walls and located over a puncturable access port on said first wall, wherein said nipple attachment piece has a flat portion to which the nipple is attached and a gently sloped portion onto which is attached a puncture piece, said puncture piece is conical, and said puncture piece is positioned over said access port, wherein depressing said sloped portion causes said puncture piece to puncture said access port to allow fluid from said container to enter said nipple.

5. A disposable nursing container according to claim 4, wherein said nipple attachment piece further comprises a peripheral lower flange which is attached to the container.

* * * * *